United States Patent [19]

Besio et al.

[11] Patent Number: 4,914,018

[45] Date of Patent: Apr. 3, 1990

[54] ANTISTATIC PHOTOGRAPHIC BASE AND LIGHT-SENSITIVE ELEMENT

[75] Inventors: Mauro Besio, Vado Ligure Savona; Alberto Valsecchi, Ferrania Savona, both of Italy

[73] Assignee: Minnesota Mining and Manufacturing Company, St. Paul, Minn.

[21] Appl. No.: 278,358

[22] Filed: Dec. 1, 1988

[30] Foreign Application Priority Data

Dec. 16, 1987 [IT] Italy ..... 23024 A/87

[51] Int. Cl.[4] ..... G03C 1/82

[52] U.S. Cl. ..... 430/528; 430/527; 430/531; 430/536; 430/961; 428/452; 428/508; 428/536

[58] Field of Search ..... 430/527, 528, 531, 536, 430/961; 428/452, 508, 536

[56] References Cited

U.S. PATENT DOCUMENTS 3,607,286 9/1971 Wood ..... 96/87 A
4,070,189 1/1978 Kelley et al. ..... 96/87 A
4,225,665 9/1980 Schadt, III ..... 430/534
4,267,266 5/1981 Shibue et al. ..... 430/527
4,585,730 4/1986 Cho ..... 430/528

FOREIGN PATENT DOCUMENTS 0018601 12/1980 European Pat. Off. .
0200395 5/1983 Fed. Rep. of Germany .

*Primary Examiner*—Hoa Van Le
*Attorney, Agent, or Firm*—Donald M. Sell; Walter N. Kirn; Mark A. Litman

[57] ABSTRACT

An improved antistatic base comprises a polymeric support film having coated thereon in sequence a first antistatic layer comprising a quaternary polyelectrolyte compound and a polymeric hydrophobic binder and a second protective layer comprising a polymeric hydrophobic binder, wherein said quaternary polyelectrolyte compound is a homopolymer or a copolymer of a diallyldialkylammonium salt compound.

The antistatic base is particularly useful as a support for light-sensitive silver halide photographic elements.

11 Claims, No Drawings

ANTISTATIC PHOTOGRAPHIC BASE AND LIGHT-SENSITIVE ELEMENT

FIELD OF THE INVENTION

The present invention relates to an antistatic base particuarly useful in photography and to a light-sensitive photographic element comprising it.

BACKGROUND OF THE ART

In general, photographic elements comprise a base having photographic layers coated on one or both sides thereof. Photographic layers are for example light-sensitive silver halide emulsion layers, intermediate layers, protective layers, antihalation layers, etc.

The base in particular comprises a film of a self-supporting natural or synthetic polymeric compound such as a poly-alpha-olefin (e.g. polyethylene or polystyrene), a cellulose ester (e.g. cellulose triacetic), polyester (e.g. polyethyleneterephthalate), a polycarbonate or paper.

Most photographic light-sensitive elements have photographic layers coated on only one side of the support, the other side being free of photographic layers. A photographic elements suitable for color reproduction comprises for example a base having coated on one side thereof blue-sensitive silver halide emulsion gelatin layer or layers, green-sensitive silver halide emulsion gelatin layer or layers and red-sensitive silver halide emulsion gelatin layer or layers associated with protective, intermediate and antihalation layers. To obtain the photographic image, said silver halide photographic elements are generally exposed and processed in developer, bleaching and fixing baths.

It is known that electrostatic charges tend to accumulate during the production and the use of photographic elements, because of some surface friction resulting from contact with other surfaces. The light-sensitive layers are sensitized by the discharge of accumulated electrostatic charges and this results in the formation of dots or branched line marks (called "static marks") upon development.

To overcome the adverse effects resulting from the accumulation of static electrical charges, it is conventional practice to include an antistatic layer in the photographic elements.

Electroconductive water-soluble polymers, such as quaternary polyelectrolyte compounds (polymeric quaternary ammonium salts), have been described for use in photographic elements as backing layers to provide static protection by preventing the static built-up through electrical conductivity. A problem with these antistatic layers is their inhability to withstand photographic processing baths and their tendency to cause photographic sheets or films to stick together or to stick to other surfaces. Such problems have been partially solved by coating onto said antistatic layers a protective layer comprising hydrophobic polymers. Such antistatic double layer constructions still suffer from other disadvantages. Thus, for example, sticking under severe temperature and humidity conditions between said double layer antistatic layer and the emulsion side of the same element or other element causes stains and ferrotyping defects (by the term "ferrotyping" in the photographic art it is meant opacity stains on the hydrophilic surface of a light-sensitive material caused by sticking). Improved antistatic compositions have been described in U.S. Pat. No. 4,070,189, in EP Patent Appln. 18,601 and in Japanese Patent Appln. J5 5057-842 and J5 5065-950. These patents describe antistatic compositions comprising highly crosslinked quaternary ammonium or phosphonium salt copolymers as electroconductive compounds, obtained by copolymerizing quaternary ammonium or phosphonium salt monomers with a copolymerizable monomer containing at least two ethylenically unsaturated groups. However, under extremely severe temperature and humidity conditions, some sticking still continues to occur. Moreover, said highly crosslinked quaternary ammonium and phosphonium salt copolymers need to be used in combination with special crosslinkable latex binders, as described for example in the before mentioned EP 18,601, in order to reduce substantially ferrotyping occurrence. These methods present a number of disadvantages, such as for example cost and difficulty in preparation of said crosslinked copolymers and binders, and troubles in separating the antistatic layer from the support to recycle the latter.

Therefore, there is a continuous need for antistatic compositions which can be coated on one side of a photographic support to provide layers having the necessary antistatic chracteristics without negatively affecting the physical characteristics, especially when said layers are put in intimate contact under extremely severe conditions with the hydrophilic radiation sensitive layers coated on the other side of the support.

U.S. Pat. No. 3,607,286 describes antistatic layers of homopolymers or copolymers of a diallyldi-alkyl ammonium salt compound coated, on the back of a photographic material, from aqueous solution or from a lower primary alcohol solution. It has been found that said binderless antistatic layers have poor adhesion to the support, poor abrasion resistance and when put in contact with hydrophilic light-sensitive layers of photographic materials cause ferrotyping and other undesirable physical defects.

SUMMARY OF THE INVENTION

In one aspect of the present invention, there is provided an improved antistatic base comprising a polymeric support film having coated thereon in sequence a first antistatic layer comprising a quaternary polyelectrolyte compound and a polymeric hydrophobic binder and a second protective layer comprising a polymeric hydrophobic binder, wherein said quaternary polyelectrolyte compound is a homopolymer or a copolymer of a diallyldialkylammonium salt compound represented by the general formula $$(CH_2{=}CH{-}CH_2)_2NR_1R_2{}^+X^-$$

wherein $R_1$ and $R_2$ are each alkyl groups and $X^-$ is an anion.

Preferably said quaternary polyelectrolyte compound is a homopolymer represented by the general formula:

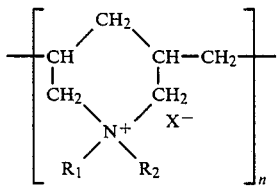

wherein $R^1$ and $R^2$ are each alkyl groups, $X^-$ is an anion and n is an integral number, or a copolymer thereof derived from at least 70 weight percent of the diallyldialkylammonium salt compound above.

The antistatic base is particularly useful as a support for photographic elements. Thus in another aspect of the present invention, there is provided a photographic element comprising a polymeric film support having coated on one side a light-sensitive silver halide emulsion layer or layers and coated on the other side a first antistatic layer and a second protective layer as above described.

The antistatic layer according to the present invention presents a low resistivity, is transparent, is resistant to ferrotyping and to sticking to hydrophilic surfaces under extremely severe conditions of temperature and humidity. It has been surprisingly found that the double layer antistatic construction of the present invention may be placed in contact with the hydrophilic light-sensitive layers of the photographic elements without adversely affecting the physical and sensitometric characteristics of the element in spite of the fact that the electroconductive polymeric compound is not crosslinked.

DETAILED DESCRIPTION OF THE INVENTION

Accordingly, the present invention relates to an antistatic base comprising, coated on a polymeric support film, a first antistatic layer comprising a homopolymer or a copolymer of a diallyldialkylammonium salt compound and a polymeric hydrophobic binder and a second protective layer comprising a polymeric hydrophobic binder.

As known in the art, diallyldialkylammonium salt compounds polymerize with an alternating intramolecular-intermolecular chain propagation mechanism (cyclopolymerization) leading to the formation of chains of recurring six-membered (piperidine) cyclic units. Even if such intramolecular cyclization could lead to other recurring cyclic units (such as five- or less probably ten-, eleven-, twelve-membered, or even larger, cyclic units), such cyclizations are much less like to occur in the case of diallyldialkylammonium salt monomers, than that which lead to six-membered recurring units. Chemical studies and analysis indicated that more than 90% of cyclic units of polymers derived by diallyldialkylammonium salt monomers are six-membered cyclic rings.

Accordingly, the homopolymers of diallyldialkylammonium salts for use in the present invention can be represented by the following general formula

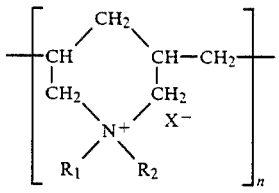

wherein $R_1$ and $R_2$ are each alkyl groups, $X^-$ is an anion and n is an integral number, or a copolymer thereof.

The alkyl groups represented by $R_1$ and $R_2$ above are preferably alkyl groups having 1 to 18 carbon atoms, more preferably 1 to 4 carbon atoms and include straight or branched chain alkyl groups. Said alkyl groups may be substituted or unsubstituted. Preferred examples of substituents of the alkyl groups include an alkoxy group, preferably an alkoxy group having 1 to 4 carbon atoms, an aryloxy group, preferably an aryloxy group having 6 to 10 carbon atoms, an acylamino group, preferably an acylamino group having 1 to 4 carbon atoms, a halogen atom, a hydroxy group, etc. The anion represented by $X^-$ above is a negatively charged radical or atom such as a halide (chloride, bromide, iodide), nitrate, sulfate, alkylsulfate, arylsulfonate (p-toluensulfonate), perchlorate, acetate, phosphate or similar anionic moiety. The integral number represented by n above is preferably 250 to 5000, more preferably 1000 to 2000.

Homopolymers of diallyldialkylammonium salt compounds have been described by G. R. Butler and R. J. Angelo in Journal American Chemical Society, Vol. 79, 3128-3131, 1957.

Copolymers of diallyldialkylammonium salt compounds for use in the present invention comprise repeating units of the above formula and minor amounts of repeating units derived from substantially photographically inert ethylenically copolymerizable monomers (preferably less than 30%, more preferably less than 20% by weight of said repeating units derived from inert monomers). Said repeating units derived from photographically inert monomers are not essential or necessary to the purpose of the present invention. If they are present, for reason of preparation or use, they are to be chosen so as not to negatively affect the photographic and physical characteristics of the antistatic layers of the present invention. Examples of inert monomers include the ethylenic monomers (such as ethylene, propylene, propenenitrile, vinyl chloride and the like), the styrene type monomers (such as styrene, vinyltoluene, chloromethylstyrene, alpha-methylstyrene, 2-ethylstyrene, 1-vinylnaphthalene and the like), the 2-alkenoic acid esters (such as methyl, ethyl, propyl, butyl, hexyl, dodecyl, hexadecyl esters of acrylic, methacrylic, alpha-ethylacrylic, alpha-propyl-acrylic, 2-butenoic, 2-hexenoic, 2-methyl-2-octenoic acids and the like), the acrylamide monomers (such as acrylamide, N-methylacrylamide, N-butylacrylamide, N,N-dimethylacrylamide, N-bromo-methylacrylamide, N-chloromethylacrylamide and the like), vinyl acetate, vinyl pyrrolidone, acrylonitrile, etc.

Copolymers of diallyldialkylammonium salt compounds are described by Schuler et al. in Journal of Chemical Engineering Date, Vol. 4, 1,273, 1959.

The first antistatic layer of the present invention have been formed by coating onto said polymeric film support a liquid coating composition prepared by dissolving the quaternary polyelectrolyte of the diallyldialkylammonium salt homopolymer or copolymer type above described in a hydrophobic polymeric binder. By the term hydrophobic it is meant that the binder is not water soluble or readily water swellable. Any hydrophobic binder that is compatible with the quaternary polyelectrolyte above is suitable. Particularly useful hydrophobic binders include cellulose derivatives such as cellulose triacetate, cellulose diacetate, cellulose acetate propionate, cellulose acetate butyrate, nitrocellulose, methylcellulose or ethylcellulose, polyalkyl(metha)acrylates such as poly-methylmethacrylate or poly-ethylacrylate and silicone resins.

The particular solvent for forming the dispersion of the diallydialkylammonium salt homopolymer or copolymers in the binder depends on the particular binder and polymeric film support chosen. Generally, said liquid composition includes a first solvent in which the antistatic polymer is poorly soluble (e.g. less than 1%) and a second solvent in which the antistatic polymer is very soluble (e.g. more than 10%). The solvent mixture must dissolve the binder and preferably soften the support on which the first antistatic layer is to be applied. Adhesion of said first antistatic layer to the support can be increased by such solvent mixture without decreasing the antistatic properties of the composition. In the case of cellulose triacetate support, a good solvent mixture is the one constituted by acetone and methanol in a relative volume ratio of about 2:1. Ratios higher than 2.5:1 of acetone to methanol give very transparent support bases with poor antistatic properties, while ratios lower than 1.5:1 of acetone to methanol show very good antistatic properties but a loss in transparency. Additional high-boiling organic solvents, such as methyl Cellosolve® acetate, may be used as known to those skilled in the art to improve the heat stability of the coating composition.

The polymeric binder to be coated on the first antistatic layer as a protective layer has to be film-forming and hydrophobic. Illustrative film-forming polymeric binders are cellulose derivatives (such as cellulose diacetate, cellulose triacetate, cellulose acetate propionate, cellulose acetate butyrate, cellulose tripropionate, methylcellulose and ethylcellulose), synthetic addition polymers and copolymers of a polymerizable monomer (such as styrene, vinyl ethers, vinyl esters, acrylic acid esters, vinyl ketones, vinyl chloride and acrylonotrile) and also synthetic condensation polymers (such as polyesters and polyurethanes).

The nature of this polymeric hydrophobic binder will be chosen depending upon the film base nature and possible technical needs. In the case of cellulose triacetate film base, for example, it may be cellulose diacetate or preferably cellulose triacetate.

The proportions of the ingredients making up the double layer antistatic construction of this invention can be widely varied to meet the requirements of the particular photographic element or base which is to be provided with an antistatic layer. Typically, the quaternary polyelectrolyte of the diallyldialkylammonium salt homopolymer or copolymer type comprising in the first antistatic layer will be employed in an amount of about 0.10 to 0.35 grams, and preferably of about 0.15 to 0.20 grams per square meter of the support base and the polymeric hydrophobic binder of said first antistatic layer will be employed in an amount of about 0.05 to 0.30 grams, and preferably of about 0.10 to 0.20 grams per square meter of the support base. The polymeric hydrophobic binder forming the second protective layer is typically employed in an amount of about 0.10 to 0.50 grams, and preferably of about 0.15 to 0.30 grams per square meter of the support base. The antistatic double layer construction of this invention can contain other ingredients in addition to the diallyldialkylammonium salt homopolymers and copolymers and to the polymeric hydrophobic binders. For example, as known in the art, there may be incorporated other additives desirable for various purposes, such as surfactants, dyes, plasticizers in the first antistatic layer, and matting agents, surfactants, slipping agents in the second protective layer.

The coating compositions as described above may be coated on any of a wide variety of supports to provide articles resistant to accumulation of static charges. The support can comprise for example any photographic support material such as paper, baryta coated paper, resin coated paper, polyethyleneterephthalate and cellulose triacetate. The support is preferably cellulose triacetate.

The present invention, in another aspect, relates to a photographic element comprising a polymeric film support, at least one photosensitive image-forming layer coated on one side of said support and an antistatic layer on the opposite side of said support, said antistatic layer being formed by a first antistatic layer and a second protective hydrophobic layer coated onto said first layer, said first layer having been formed by coating onto said support a liquid coating composition comprising a diallyldialkylammonium salt homopolymer or copolymer and a polymeric hydrophobic binder, as described above.

The photosensitive and/or radiation sensitive layers useful for the present invention may be those well-known for imaging and reproduction in the fields such as graphic arts, printing, medical and information systems. Photopolymer, diazo, vesicular image-forming compositions and other systems may be used in addition to silver halide. Photographic silver halide emulsions may be of various content and be negative and/or positive working. The response of the silver halide emulsions may be enhanced and stabilized by such chemical agents as boranes, amines, polyethylene oxides, tetrazaindenes, benzotriazoles, alkali halides, phenylmercaptotetrazoles and gold, mercury and sulfer compounds. In addition, dyes, development modifiers, covering power polymers, surfactants, latices, hardeners and other addenda known in the photographic art may be employed with the photographic silver halide emulsion.

The following experimental work will be able to illustrate better the present invention. The technique used for coating the various layer compositions of the present invention was the so called doctor-roller technique, according to which the film base is not directly dipped into the coating composition (in the form of a solution), but receives it form a feeding roller dipping into the tray.

Every layer of the support base of the present invention was dried for 2 or 3 minutes at a temperature of about 60°–70° C. before coating thereon a further coating composition at a coating speed of about 350 m/h.

The antistaticity test were made on the support base of the present invention or on a photographic element including it according to the present invention. The photographic element was including the support base of the present invention having an antistatic layer and a protective layer thereof coated on one side of it plus gelatin silver halide emulsion layers, gelatin interlayers and protective gelatin layers (particularly silver halide emulsion layers associated with dye-forming couplers, spectral sensitizers, hardeners and any other useful chemical adjuvants known to the man skilled in the art, such as filter dyes, surfactants, antifog agents and stabilizers), coated on the other side. Specific tests were made on Color Negative films processed in a normal C41 type process for Color Negative films, as described in British Journal of Photography, July 12, 1974, pp. 597–598. The support base and the Color Negative films including it (conditioned for 15 hours at 21° C. and 25% R.H.) were evaluated by measuring the electrical resistivity. The yellow patterns were evaluated by winding up a sample of 35 mm. base 2 m. long bearing on its back the antistatic layer in contact with the emulsion side of a 3M Color Print 100 ASA film and conditioning for 5 hours at 70° C. and 90% R.H. and then for 24 hours at 21° C. and 5% R.H. After the artificial ageing, the samples of photographic film were developed in a C 41 processing line and their surface evaluated for the occurrence of yellow patterns using a scholastic rating: when the surface was completely full of yellow patterns the score was 0 and when it was completely free of yellow patterns the score was 10. The ferrotyping was evaluated by winding up a sample of 35 mm. base 2 m. long bearing on its back the antistatic layer in contact with the emulsion side of a 3M Color Print 100 ASA film and conditioning for 24 hours at 60° C. and 75% R.H. After the artificial ageing, the samples of photographic film were developed in a C 41 processing line and their surface evaluated for the occurrence of ferrotyping using a scholastic rating: when the surface was completely full of sticking marks the score was 0 and when it was completely free of sticking marking the score was 10. The film transparency was evaluated by scanning the surface of the antistatic double layer construction of the support base and evaluating its transparency using a scholastic rating: when the surface was completely full of opaque marks, pinholes, craters, blisters, etc. the score was 0, when the surface was completely clear the score was 10.

The poly-N,N-dimethyl-3,5-dimethylenepiperidinium chloride referred to in the following examples was one having an intrisic viscosity of 0.45 dl/g. measured in $NaNO_3$ 0.5M at 20° C. corresponding to an average molecular weight of about 247,000 (calculated as described in European Polymer Journal, Vol. 13, pp. 109–112, 1977) and an average degree of polymerization (corresponding to n of the general formula above) of about 1530. The styrene/vinylbenzyl pyridinium chloride copolymer was one having an intrinsic viscosity of 0.057 dl/g measured in ethanol/0.5M NaCl (10/90 vol. by vol.). The polyvinylbenzyl pyridinium chloride was one having an intrinsic viscosity of 0.126 dl/g measured in methanol/0.25M NaCl (10/90 vol. by vol.)

EXAMPLE 1

Four antistatic coating compositions (A, B, C and D) were prepared according to the following formulations:

| | | A | B | C | D |
|---|---|---|---|---|---|
| Benzyltrimethylammonium chloride | g | 5 | — | — | — |
| Styrene/vinylbenzyl pyridinium chloride copolymer | g | — | 5 | — | — |
| Poly-N,N-dimethyl-3,5-dimethylenepiperidinium chloride | g | — | — | 5 | — |
| Poly-vinylbenzyl pyridinium chloride | g | — | — | — | 5 |
| Cellulose diacetate | g | 3 | 3 | 3 | 3 |
| Methanol | ml | 600 | 600 | 600 | 600 |
| Acetone | ml | 300 | 300 | 300 | 300 |
| Methyl Cellosolve(R) acetate | ml | 100 | 100 | 100 | 100 |

Said coating compositions were each coated on the backing side of different portions of a cellulose triacetate support base (having coated on the front side a gelatin subbing layer) at a rate of 30 ml/m². After 2–3 minute drying at 70° C., each antistatic layer was coated with a protective layer obtained from the following coating composition:

| | | |
|---|---|---|
| Cellulose diacetate | g | 5 |
| Colloidal silica (30% by weight aq. sol.) | g | 6 |
| Methanol | ml | 400 |
| Acetone | ml | 600 |

After 10–12 minute drying at 70° C., the electrical resistivity, yellow pattern and ferrotyping occurrence were evaluated as described before.

The following table reports the values of resistivity and the evaluations of yellow pattern and ferrotyping occurrence in comparison with a cellulose triacetate support base with no antistatic layer.

| Base | Composition of antistatic layer | Electrical Resistivity ohms/sq | Yellow pattern | Ferrotyping |
|---|---|---|---|---|
| 1 | — | $6.10^{15}$ | 5 | 7 |
| 2 | A | $5.10^{15}$ | 5 | 5 |
| 3 | B | $8.10^{13}$ | 8 | 6 |
| 4 | C | $4.10^{9}$ | 8 | 9 |
| 5 | D | $4.10^{11}$ | 9 | 6 |

The double layer antistatic layer comprising the poly-N,N-dimethyl-3,5-dimethylenepiperidinium chloride of support base 4 according to the present invention resulted to have the lower electrical resistivity and the best ferrotyping characteristics.

EXAMPLE 2

Support bases were prepared having a first antistatic layer obtained from the coating composition C of Example 1 and a second protective layer obtained from the following compositions:

| | | E | F | G |
|---|---|---|---|---|
| Cellulose diacetate | g | 5 | — | — |
| Cellulose triacetate | g | — | 4.5 | — |
| Polymethylmethacrylate | g | — | — | 10 |
| Colloidal silica (30% by weight aq. solution) | g | 6 | — | 6 |
| Methylene chloride | ml | — | 900 | — |
| Methyl Cellosolve(R) acetate | ml | — | 100 | 60 |
| Methanol | ml | 400 | — | 280 |
| Acetone | ml | 600 | — | 660 |

The electrical resistivity of the backing antistatic layer was measured and the ferrotyping occurrence and film transparency were evaluated as described before.

The following table reports the values of electrical resistivity and the evaluation of ferrotyping and film transparency.

| Base | Composition of protective layer | Electrical Resistivity ohms/sq | Film transp. | Ferrotyping |
|---|---|---|---|---|
| 6 | E | $4.10^{9}$ | 6 | 9 |
| 7 | F | $6.10^{9}$ | 9 | 7 |
| 8 | G | $1.10^{10}$ | 5 | 5 |

EXAMPLE 3

Support bases were prepared having a first antistatic layer obtained from coating compositions of the following formulations:

| | | H | I | L |
|---|---|---|---|---|
| Poly-N,N-dimethyl-3,5-dimethylenepiperidinium chloride | g | 5 | 5 | 5 |
| Cellulose diacetate | g | 3 | — | — |
| Polymethylmethacrylate | g | — | 3 | — |
| Cellulose acetobutyrate | g | — | — | 3 |
| Methanol | ml | 600 | 600 | 600 |
| Acetone | ml | 300 | 300 | 300 |
| Methyl Cellosolve(R) acetate | ml | 100 | 100 | 100 |

and a second protective layer obtained from the following coating composition:

| | | |
|---|---|---|
| Cellulose triacetate | g | 5 |
| Methylene chloride | ml | 900 |
| Methyl Cellosolve(R) acetate | ml | 100 |

The electrical resistivity of the backing antistatic layer was measured and the ferrotyping occurrence and film transparency were evaluated as described before.

The following table reports the values of electrical resistivity and the evaluation of ferrotyping and film transparency.

| Base | Composition of protective layer | Electrical Resistivity ohms/sq | Film transp. | Ferrotyping |
|---|---|---|---|---|
| 9 | H | $3.10^9$ | 9 | 8 |
| 10 | I | $2.10^{10}$ | 4 | 8 |
| 11 | L | $3.10^9$ | 5 | 9 |

We claim:

1. A base for use in a photographic element comprising a polymeric support film having coated thereon in sequence a first antistatic layer comprising a quaternary polyelectrolyte compound and a polymeric hydrophobic binder and a second protective layer comprising a polymeric hydrophobic binder, characterized in that said quaternary polyelectrolyte compound is a homopolymer or a copolymer of a diallyldialkylammonium salt compound.

2. The photographic base as claimed in claim 1, wherein said quaternary polyelectrolyte compound is a homopolymer represented by the general formula

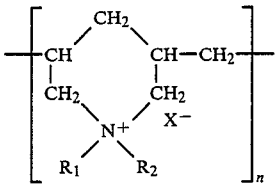

wherein $R_1$ and $R_2$ are each alkyl groups, $X^-$ is an anion and n is an integral number, or a copolymer thereof.

3. The photographic base as claimed in claim 1, wherein said quaternary polyelectrolyte compound is a poly-N,N-dimethyl-3,5-dimethylenepiperidinium chloride.

4. The photographic base as claimed in claim 1, wherein said polymeric film support is cellulose triacetate.

5. The photographic base as claimed in claim 1, wherein said first antistatic layer comprises as a polymeric hydrophobic binder a cellulose derivative, a polyalkyl(meth)acrylate or a silicone resin.

6. The photographic base as claimed in claim 5, wherein said cellulose derivative is cellulose diacetate, cellulose triacetate, cellulose acetate propionate, cellulose acetate butyrate, nitrocellulose, methylcellulose or ethylcellulose.

7. The photographic base as claimed in claim 1, wherein said second protective layer comprises as a polymeric hydrophobic binder a cellulose derivative.

8. The photographic base as claimed in claim 1, wherein said quaternary polyelectrolite compound is present as from 0.10 to 0.35 grams per square meter on said polymeric film support.

9. The photographic base as claimed in claim 1, wherein said polymeric hydrophobic binder is said firs antistatic layer is present as from 0.05 to 0.30 grams per square meter on said polymeric film support.

10. The photographic base as claimed in claim 1, wherein said polymeric hydrophobic binder of said second protective layer is present as from 0.10 to 0.50 grams per square meter on said polymeric film support.

11. A photographic element comprising a polymeric film support having coated on one side a light-sensitive silver halide emulsion layer or layers and coated on the other side a first antistatic layer and a second protective layer of claim 1.

* * * * *

UNITED STATES PATENT AND TRADEMARK OFFICE

CERTIFICATE OF CORRECTION

PATENT NO. : 4,914,018

DATED : April 3, 1990

INVENTOR(S) : Besio and Valsecchi

It is certified that error appears in the above-identified patent and that said Letters Patent is hereby corrected as shown below:

Column 1, line 19, "triacetic" should be --triacetate--.

Column 1, line 25, "elements" should be --element--.

Column 1, line 51, "built-up" should be --build-up--.

Column 7, line 19, "marking" should be --marks--.

Signed and Sealed this

Twenty-second Day of October, 1991

*Attest:*

HARRY F. MANBECK, JR.

*Attesting Officer*

*Commissioner of Patents and Trademarks*